United States Patent [19]

Ferenczffy

[11] Patent Number: 4,938,264

[45] Date of Patent: Jul. 3, 1990

[54] ROUTING CUTTER

[75] Inventor: Ladislaus Ferenczffy, Leinfelden-Echterdingen, Fed. Rep. of Germany

[73] Assignee: Robert Bosch GmbH, Stuttgart, Fed. Rep. of Germany

[21] Appl. No.: 371,421

[22] Filed: Jun. 26, 1989

[30] Foreign Application Priority Data

Jul. 16, 1988 [DE] Fed. Rep. of Germany ..... 3824200

[51] Int. Cl.[5] ..... B27C 5/00

[52] U.S. Cl. ..... 144/134 D; 409/182

[58] Field of Search ..... 144/134 R, 134 D, 136 C; 409/182

[56] References Cited

U.S. PATENT DOCUMENTS

| | | | |
|---|---|---|---|
| 3,487,747 | 1/1970 | Burrows et al. | 144/136 C |
| 3,791,260 | 2/1974 | Ambler | 409/182 |
| 4,102,370 | 7/1978 | Vess | 409/182 |
| 4,108,225 | 8/1978 | Hestily | 409/182 |
| 4,318,224 | 3/1982 | Getts | 144/136 C |
| 4,319,860 | 3/1982 | Beares | 144/136 C |
| 4,445,811 | 5/1984 | Sanders | 409/184 |
| 4,606,685 | 8/1986 | Maier et al. | 409/182 |
| 4,652,191 | 3/1987 | Bernier | 144/136 C |
| 4,770,573 | 9/1988 | Monobe | 409/184 |

*Primary Examiner*—W. Donald Bray
*Attorney, Agent, or Firm*—Michael J. Striker

[57] ABSTRACT

A routing cutter comprises drive means, an upper housing part arranged to receive the drive means and having a lower side, a cutting tool arranged at the lower side of the upper housing part, a base plate displaceable substantially vertically relative to the upper housing part, and fixable relative to the latter, and means for guiding the base plate and including a column guide, the column guide including a sleeve which is arranged in the upper housing part and displaceable relative to the latter in a displacement direction of the column guide, the column also having a rod which is connected with the base plate and fixably guided in the sleeve.

16 Claims, 4 Drawing Sheets

ROUTING CUTTER

BACKGROUND OF THE INVENTION

The present invention relates to a routing cutter. More particularly, it relates to such a routing cutter which has an upper housing part accommodating a drive motor and provided with a cutting tool at its lower side, and a base plate which is displaceable and fixable relative to the upper housing part through a column guide.

Routing tools of the above mentioned general type are known in the art. One of such routing tools is disclosed in the German document DE-PS No. 3,347,764. In this routing tool the height adjusting device is formed as a spindle which curves a swinging projection for turning the cutting tool introduced in the workpiece under the head of an adjusting screw arranged in a revolving abutment on the supporting table. During the cutting, the supporting table is fixed relative to the upper housing part by means of an arresting screw additionally on the column guide arranged between the supporting plate and the upper housing part.

A return spring is arranged between the supporting plate and the upper housing part and serves for automatically pressing back the supporting plate acting as a supporting ring, after release of the arresting devices. Therefore a contact of the cutting tool in the final position is prevented. The depth limitation of this known routing cutter can also be released by a handle for performing respective accident preventing measures. Thereby a second handle is required for spring biasing the supporting plate back after the release of the arresting screw.

SUMMARY OF THE INVENTION

Accordingly, it is an object of the present invention to provide a routing cutter in which the respective accident preventing steps can be performed better, and every time the tool can be lowered onto the workpiece only with a single handle and can be moved back behind the protective ring.

This is very important since the routing cutters because of the high rotary speed and their sharp-edges tools pause extraordinarily high dangers. Since these manual machines are used in free time by non-experienced people, a considerable simplification is required for their handling.

In keeping with these objects and with others which will become apparent hereinafter, one feature of the present invention resides, briefly stated, in a routing tool of the above mentioned general type in which the column guide includes a sleeve arranged in the upper housing part and displaceable in the displacement direction of the column guide relative to the upper housing part, and a rod fixable to and adapted to be guided in the sleeve and connected with the base plate.

When the routing cutter is designed in accordance with the present invention, the cutting tool every time can be moved back behind the protective ring with a single handle. This results in a previously unknown advantage in the safety of the operation of such cutting machines. At the same time, a fine adjustment of different cutting depths preadjusted by means of revolving abutments in modern routing cutters can be obtained to the full extent, and also the possibility of a post-adjustment is maintained. In accordance with the present invention with the coarsely adjusted cutting depth, a well-accessible rotary knob provides an adjustment in correspondence with the scale without releasing the clamping device.

It is especially advantageous when the rotary knob is provided with a scale ring adjustable relative to the rotary knob. In this manner the zero point of the scale can be set at any arbitrary position to improve the operational comfort. Furthermore, the fine adjustment can be obtained by a thread-containing sleeve against the force of a pressure spring. Thereby inaccuracies are prevented, which can result from expected thread play.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
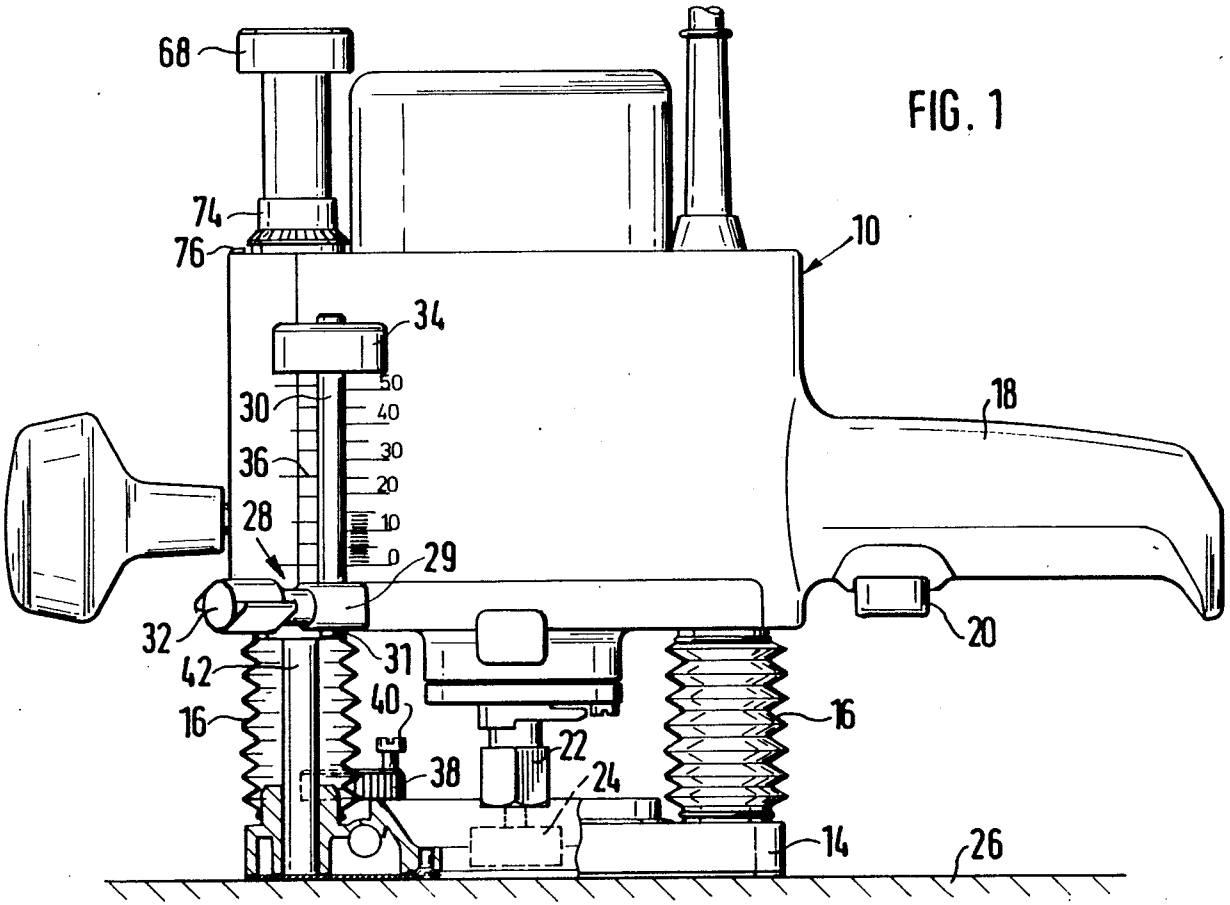
FIG. 1 is a side view of a routing cutter in accordance with the present invention in position placed on a workpiece.
Figure 2:
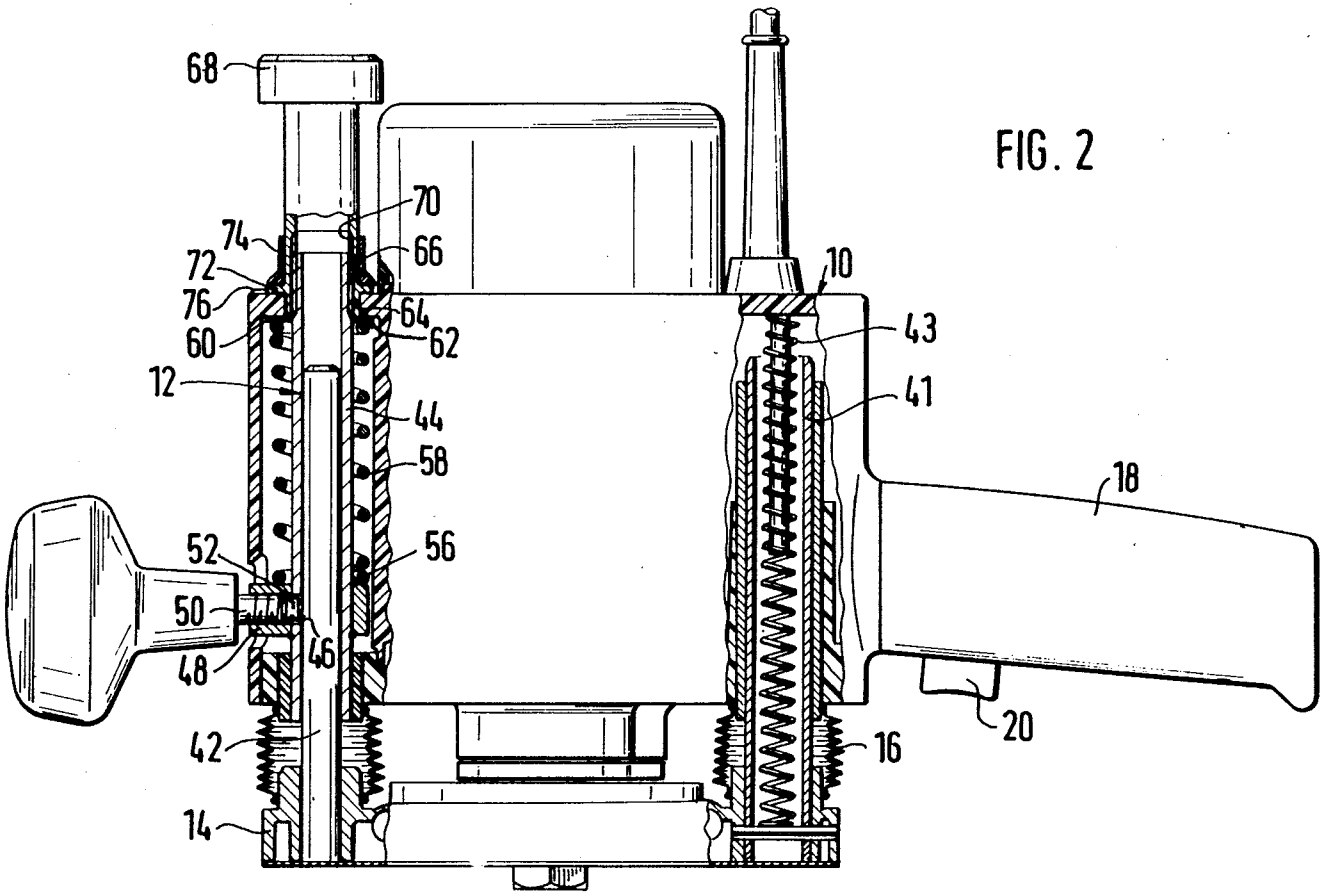
FIG. 2 is a partial side view of the routing cutter in a working position.
Figure 3:
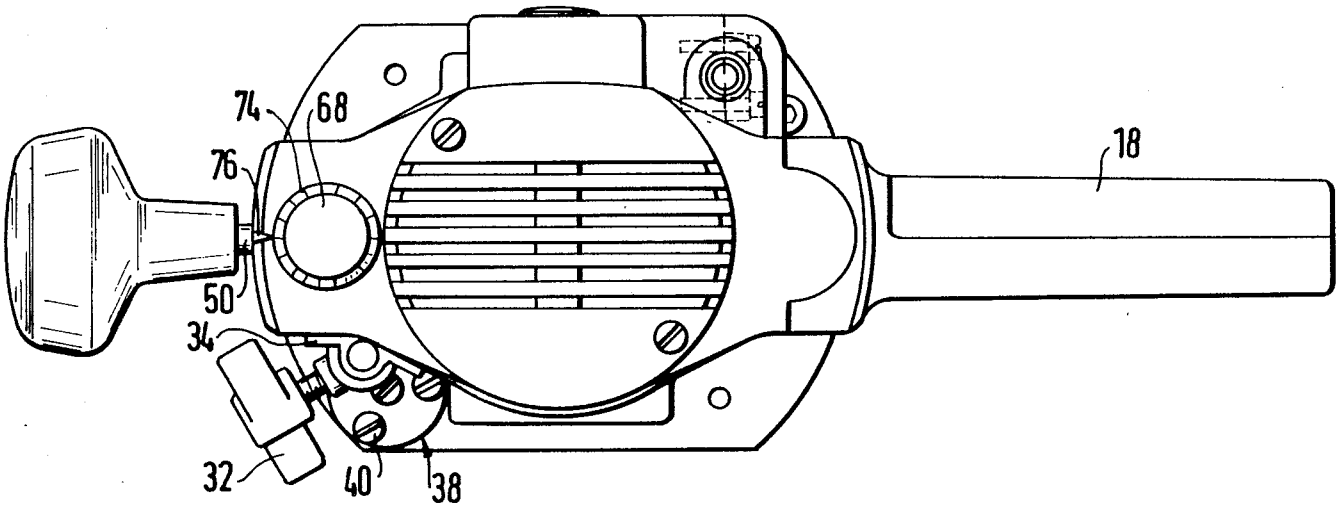
FIG. 3 is a plan view of the routing cutter in accordance with the present invention.

A routing cutter shown in FIG. 1 has a housing with an upper housing part 10 which is connected through a column guide 12 of FIG. 2 with a base plate 14. A bellows 16 protects the column guide from dirtying. A handle 18 is mounted on the upper housing part 10 and has a switching handle 20 which controls a drive motor arranged in the upper housing part 10. The drive motor drives a milling or cutting tool 24 which is inserted in a collet 22 and illustrated in broken lines. The tool 24 has a vertical axis. The routing cutter is placed with its base plate 14 on an upper surface of the workpiece 26. In a known manner, a cutting depth coarse adjusting device 28 is provided outside of the upper housing part.

The adjusting device 28 includes a bar 30 which is arranged displaceably in the vertical direction in a guide 29 and arrestable by a clamping screw 32. The bar 30 is provided at its upper end with an indicating mark 34 associated with a scale 36 provided on the upper housing part 10 for obtaining respective readings. The above mentioned cutting depth coarse adjusting device 28 also includes a revolving abutment 38 arranged rotatably on the outer side of the base plate 14. Abutment screws 40 are inserted in a known manner in the revolving abutment 38. The lower end 31 of the bar 30 abuts against the heads of the abutment screws 40.

In FIG. 2 the adjusting device 28 of FIG. 1 is not shown for the sake of clarity of the drawing. The right column in the drawing of the column guide is designed in a known manner. It has a hollow rod 41 which is fixedly connected with the base plate 14. A pressure spring 43 is located in the hollow rod 41 and abuts against the base plate 14 and the upper housing part 10. The rod 41 is displaceably guided in the upper housing part 10.

A rod 42 is also fixedly connected with the base plate as can be seen in FIG. 2. A sleeve 44 which is closed at its upper end is guided on the rod 42. The sleeve 44 is guided in an axially displaceable manner in the upper housing part 10 and has an opening 46 which extends radially to the sleeve axis in the lower region. A clamping ring 48 is mounted at the height of the opening 46 outside of the sleeve 44.

The clamping ring 48 has a radial thickening with an inwardly threaded opening in alignment with the opening 46. A clamping screw 50 is screwed in this inwardly threaded opening. A pressing member 52 is arranged between the clamping screw 50 and the rod 42. The upper end surface of the clamping ring 48 forms a lower abutment shoulder 56 for a pressure spring 58 arranged around the sleeve 44.

The pressure spring 58 acts within the position of a disc 60 on an abutment shoulder 62 formed on the upper housing part 10. The abutment shoulder 62 is arranged around an opening 64 in the upper housing part 10. The upper region of the sleeve 44 provided with outer thread 66 extends through the opening 64 outwardly of the upper housing part 10.

A rotary know 68 which is sleeve-shaped in its lower region has there an inner thread 70 that cooperates with the outer thread 66 formed in the upper sleeve 44, to displace the sleeve 44 vertically whereby a fine adjustment is effected. The rotary knob 68 is centered in its lower end in the opening 64. A collar 72 of the rotary knob 68 abuts outside of the upper housing part 10 and positions the rotary knob 68 in the axial direction.

A scale ring 74 sits on the outer side of the collar 72. The fit between the scale ring 74 and the rotary knob 68 is dimensioned so that the scale ring 74 can be rotated easily by hand relative to the rotary knob 68. An adjusting mark 76 is formed on the upper housing part 10 and corresponds with the scale ring 74.

During the operation with the routing cutter, first the required cutting depth is coarsely adjustment on the abutment screws 40 in FIG. 1. When several abutment depths are to be adjusted, this can be achieved by respective rotation of the abutment screws 40. The number of revolutions in connection with the thread pitch of the abutment screws 40 determine a stabbing point. In this manner the basic adjustment is performed.

When it is determined during subsequent testing cutting or during operation with the inventive routing cutter that the cutting depth previously adjusted on the abutment screws 40 requires a correction, this is performed without releasing the clamping screw 50 on the rotary knob 68. When bar 30 of the cutting depth coarse adjusting device 28 eventually abuts against the head of an abutment screw 40, the clamping screw 32 of FIG. 1 is temporarily released.

In this manner the fine adjustment can be performed by rotation of the rotary knob 68 in FIG. 2. The repeatability of the depth adjustment by the cutting depth coarse adjusting device 28 is guaranteed in connection with the abutment screw 40. The scale ring 74 which is adjustable each time to its zero point provides for an additional facilitation.

During the cutting process the base plate 14 is arrested against the upper housing part 10 only by the clamping screw 50. For permitting a risk free stopping of the routing cutter after the end of the cutting process, the base plate in the manual routing cutter machines serves as an automatically back springing protecting ring which surrounds the cutting tool and thereby reduces the danger. For this purpose it is required that the arresting of the base plate 14 relative to the upper housing part 10 is released with a movement of the handle.

In the inventive routing cutter this requirement is fulfilled when a short rotation of the clamping screw 50 releases the arresting and the cutting tool 24 is pulled because of the pressure spring 43 acting as a return spring, behind the outer contour of the base plate 14 back and can be stopped without danger.

Figure 4:
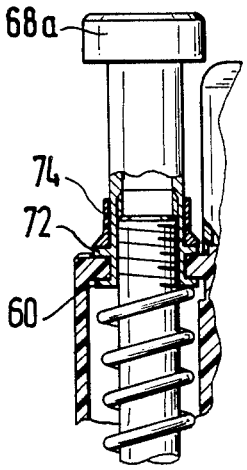
FIG. 4 is a section of a routing cutter in accordance with the second embodiment of the present invention.

A different embodiment shown in FIG. 4 differs from the above described embodiment in that the disc 60 is formed directly on the rotary knob 68*b*. The mounting of such a rotary knob 68*b* is easily possible when the upper housing part 10 is formed of shells with a separating plane extending parallel to the cutter axis. This mounting can be performed before the connection of the housing shells.

Figure 5:
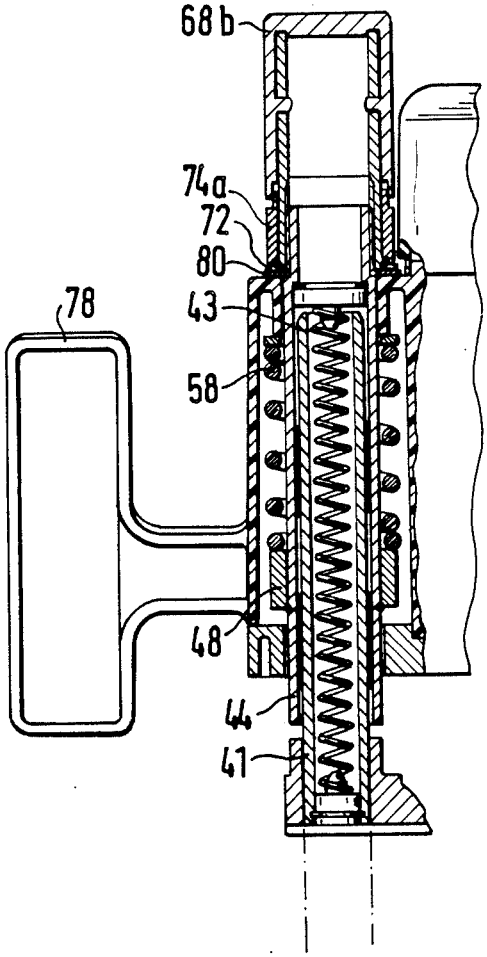
FIG. 5 is a view showing a routing cutter in accordance with the third embodiment of the present invention.

Further modifications of the above described invention are also possible. It is for example possible to form the left rod of the column guide which surrounds the sleeve 44 also has a whole rod 41. This embodiment is shown in FIG. 5. Here also the design of the rotary knob 68*b* and the scale ring 74*a* is varied. The clamping screw 50 which acts on this rod is turned in this Figure from the plane of the drawing and therefore not seen in FIG. 5.

This clamping screw can be formed for example as a wing screw which can be operated from a handle 78 formed on the upper housing part 10.

In the embodiment of FIG. 5 a disc 80 with a friction reducing coating is provided between the contact surfaces on the collar 72 and the upper housing part 10. This facilitates the fine adjusting process. Instead of the above mentioned disc 80 also an axial roller bearing can be utilized.

It will be understood that each of the elements described above, or two or more together, may also find a useful application in other types of constructions differing from the types described above.

While the invention has been illustrated and described as embodied in a routing cutter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A routing cutter, comprising drive means; and upper housing part arranged to receive said drive means and having a lower side; a cutting tool arranged at said lower side of said upper housing part; a base plate displaceable substantially vertically relative to said upper housing part, and fixable relative to the latter; means for guiding said base plate and including a column guide, said column guide including a sleeve which is arranged in said upper housing part and, is guided in said sleeve, and is fixable thereto; and means cooperating with said upper housing part for displacing said sleeve relative to said upper housing part in a displacement direction of said base plate.

2. A routing cutter as defined in claim 1, wherein said routing tool has a vertical axis, said base being displaceable in a direction extending parallel to the vertical axis of said routing tool.

3. A routing cutter as defined in claim 1, wherein said displacing means has an inner thread, said sleeve having a thread which cooperates with said inner thread of said displacing means.

4. A routing cutter as defined in claim 3, wherein said thread of said sleeve is formed as an outer thread provided on said sleeve.

5. A routing cutter as defined in claim 3, wherein said displacing means comprises at least partially sleeve-shaped adjusting element arranged on said upper housing part, said inner thread being provided in said adjusting element.

6. A routing cutter as defined in claim 5, wherein said adjusting element is formed as a rotary knob.

7. A routing cutter as defined in claim 1, wherein said sleeve has an abutment shoulder; and further comprising a pressure spring located between said abutment shoulder of said sleeve and said upper housing part and operative so that said sleeve is displaceable against a force of said pressure spring.

8. A routing cutter as defined in claim 5, wherein said adjusting element has a rotatable scale; and further comprising an adjusting mark provided on said upper housing part and cooperating with said scale.

9. A routing cutter as defined in claim 8, wherein said rotatable scale is formed to provide a zero position adjustment.

10. A routing cutter as defined in claim 10, wherein said adjusting element is formed as a rotary knob, said scale being formed as a scale ring which is frictionally mounted on said rotary knob.

11. A routing cutter as defined in claim 10, wherein said rotary knob and said scale ring are formed so that a friction coefficient between them permits a user to rotate said scale ring manually.

12. A routing cutter as defined in claim 1, and further comprising a clamping device arranged perpendicularly to said displacement direction of said base and acting on said rod so as to fix said rod to said sleeve.

13. A routing cutter as defined in claim 12, wherein said clamping device includes a threaded hole formed in a wall of said sleeve and a clamping screw insertable in said threaded hole.

14. A routing cutter as defined in claim 13; and further comprising a pressing piece arranged between said clamping screw and said rod so that said clamping device acts through said pressing piece on said rod.

15. A routing cutter comprising drive means; an upper housing part accommodating said drive means and having a lower side, a cutting tool arranged on said lower side of said upper housing part; a base plate displaceable relative to said upper housing part and fixable; a column guide by means said base plate is displaceable and fixable relative to said upper housing part, said column guide having rods; and a tubular portion composed of an elastic material and having end sides connected with said upper housing part and said base plate, said tubular portion surrounding said rods of said column guide.

16. A routing cutter as defined in claim 15, wherein said tubular portion is formed as a bellows.

* * * * *